US009296115B2

(12) United States Patent
Wong

(10) Patent No.: US 9,296,115 B2
(45) Date of Patent: Mar. 29, 2016

(54) CHEESE SLICER

(71) Applicant: King's Flair Development Ltd., Hong Kong (HK)

(72) Inventor: Siu Wah Wong, Hong Kong (HK)

(73) Assignee: King's Flair Development Ltd. (HK)

( * ) Notice: Subject to any disclaimer, the term of this patent is extended or adjusted under 35 U.S.C. 154(b) by 123 days.

(21) Appl. No.: 14/256,099

(22) Filed: Apr. 18, 2014

(65) Prior Publication Data

US 2015/0298323 A1 Oct. 22, 2015

(51) Int. Cl.
*B26B 3/03* (2006.01)
*B26B 29/06* (2006.01)

(52) U.S. Cl.
CPC ..... *B26B 3/03* (2013.01); *B26B 29/063* (2013.01)

(58) Field of Classification Search
CPC ..... B26B 3/03; B26B 29/063; B26D 3/283; B26D 2003/285; B26D 2003/287
See application file for complete search history.

(56) References Cited

U.S. PATENT DOCUMENTS 8,151,678 B2 * 4/2012 Mah ..... B26D 3/283 83/397
8,813,640 B2 * 8/2014 Wong ..... B26D 3/283 83/856
8,839,702 B2 * 9/2014 Bagley ..... B26D 3/283 83/425.3
8,893,602 B2 * 11/2014 Fung ..... A47J 43/25 83/727
2004/0231482 A1 * 11/2004 Boilen ..... B26D 3/283 83/425.3
2006/0075872 A1 * 4/2006 Wangler ..... B26D 3/283 83/856
2008/0098866 A1 * 5/2008 DiPietro ..... B26D 3/283 83/440.2
2009/0255391 A1 * 10/2009 Hood ..... B26D 3/283 83/648
2015/0246457 A1 * 9/2015 Wong ..... B26B 3/03 30/279.6
2015/0298323 A1 * 10/2015 Wong ..... B26B 29/063 30/280

FOREIGN PATENT DOCUMENTS

WO WO 2012/136742 A1 * 10/2012

* cited by examiner

*Primary Examiner* — Hwei C Payer
(74) *Attorney, Agent, or Firm* — Wendy K. Marsh

(57) ABSTRACT

The present invention provides a cheese slicer adjustable for slicing cheese in variable thicknesses, comprising a handle; a guiding plate pivotally connected to the handle; a slicing plate having a slicing blade, wherein the slicing blade and the guiding plate together define a gap as slice thickness; a linkage movably resting against the guiding plate so that the movement of the linkage enables the guiding plate to pivot around the handle relative to the slicing blade thereby to provide variable slice thickness for the item to be sliced; an actuator assembly in operative connection with the linkage to move the linkage on the guiding plate. The cheese slicer of the present invention further comprises an indicating mechanism to clearly indicate the selected thickness of the sliced cheese.

14 Claims, 8 Drawing Sheets

CHEESE SLICER

TECHNICAL FIELD OF THE INVENTION

This invention relates generally to a cheese slicer, and particularly, to a cheese slicer that is adjustable to slice cheese in variable thicknesses.

BACKGROUND OF THE INVENTION

Cheese slicers are used for slicing cheese into slices. A typical cheese slicer comprises a handle and a slicing plate fixed to an end of the handle, and one edge of the slicing plate being configured as a sharp slicing blade. The slicing blade of the slicing plate is positioned with a gap from the end of the handle. The cheese slices pass through the gap between the slicing blade and the end of the handle. Therefore, the width of the gap determines the thickness of the sliced cheese pieces. In conventional cheese slicers, the gap between the slicing blade and the end of the handle is fixed, and therefore it is impossible to adjust the thickness of the cheese slices.

Cheese slicers that are adjustable to provide variable cheese slice thickness have recently been developed. In these adjustable cheese slicers, the gap between the slicing blade and the end of the handle is configured to be adjustable. However, the operation for adjusting the gap between the slicing blade and the end of the handle of these cheese slicers is rather awkward. For example, one example of the adjustable cheese slicers requires the user to rotate a dial arranged on the handle to adjust the slice thickness, which generally requires using both hands to do it. Another drawback of the adjustable cheese slicers is that no indication of the width of the variable gap is provided, making it difficult for the user to know the slice thickness before the cheese is sliced.

Therefore, there is a need for a cheese slicer which can be easily and conveniently adjusted to slice cheese into slices of variable thicknesses, and which provides a clear indication of the slice thickness to be selected.

SUMMARY OF THE INVENTION

The present invention has a principle object of providing a cheese slicer which is adjustable to provide variable slice thicknesses of the cheese to be sliced. More particularly, the present invention aims to provide a cheese slicer which can be conveniently adjusted for slicing cheese into slices of different thicknesses by for example pressing a ballpoint pen ratchet mechanism provided on the cheese slicer. Furthermore, the present invention aims to provide a cheese slicer which comprises an indicator mechanism to clearly indicate the selected thickness of the cheese slices.

These and other objects are satisfied by the present invention, which provides a cheese slicer comprising:

a handle having a first end and a second end;

a guiding plate having a proximal end pivotally connected to the first end of the handle, and a distal end;

a slicing plate having a slicing blade, wherein the slicing blade and the distal end of the guiding plate together define a gap as slice thickness for an item to be sliced;

a linkage accommodated in the handle and movably resting against the guiding plate so that the movement of the linkage enables the guiding plate to pivot around the first end of the handle relative to the slicing blade thereby to provide variable slice thickness for the item to be sliced; and an actuator assembly in operative connection with the linkage to move the linkage on the guiding plate.

Preferably, the guiding plate may be pivotally connected to the first end of the handle by a hinge, and a torsion spring may be provided beneath the guiding plate to bias the guiding plate to pivot upward.

Preferably, the slicing plate may comprise a pair of side panels on opposite sides thereof for guiding the sliced cheese, and the slicing blade may be provided as a slicing edge formed integrally with the slicing plate, while the distal end of the guiding plate may be formed as a step by downwardly extending the guiding plate.

In one embodiment of the invention, a guiding plate carrier may be provided to support the guiding plate, and the guiding plate carrier may extend from the first end of the handle.

In a preferred embodiment of the present invention, the linkage may be configured to slide to a plurality of resting positions on the guiding plate to create a plurality of predetermined slice thicknesses. Preferably, the actuator assembly may be configured as a ballpoint pen ratchet mechanism provided in the handle, which is latched in a plurality of locked positions, so that the plurality of locked positions are respectively correspondent to the plurality of resting positions of the linkage on the guiding plate. The ballpoint pen ratchet mechanism may comprise a push plunger and a ratchet connected to a compression spring which is forced to move the ratchet upward and coupled to the linkage. The push plunger and the ratchet may comprise cooperating cam faces whereby the ratchet tends to rotate when the cam faces of the push plunger are forced against the cam faces of the ratchet, and the rotation of the ratchet results in an axial displacement of the ratchet among the plurality of locked positions, which causes the linkage to slide to the plurality of resting positions.

The ballpoint pen ratchet mechanism may further comprise a sleeve having a plurality of spaced apart axial slots of different lengths formed on an inner wall thereof; and the ratchet may comprise an axial rib which is rotated to alternately engage with the respective axial slots of the sleeve, thereby allowing the ratchet to reach the respective locked positions. Preferably, the ballpoint pen ratchet mechanism may comprise a button fixedly connected to the push plunger and extending beyond the second end of the handle.

In a preferred embodiment of the present invention, the linkage may be configured to have a first portion terminated by a crossbar resting on the guiding plate, and a second portion having one end rotatably coupled to the first portion and the other end fixed to the ratchet.

In a preferred embodiment of the present invention, the handle may comprise an indicating window; and a plurality of indicators corresponding to the slice thicknesses to be selected may be arranged on the linkage and configured in such a manner that the indicator corresponding to the selected slice thickness moves to be exposed through the indicating window with the movement of the linkage to a position on the guiding plate which creates the selected slice thickness.

To have a better understanding of the invention reference is made to the following detailed description of the invention and embodiments thereof in conjunction with the accompanying drawings.

DETAILED DESCRIPTION OF THE INVENTION

While this invention is illustrated and described in preferred embodiments, the cheese slicer of the present invention may be produced in many different configurations, sizes, forms and materials.

Figure 1:
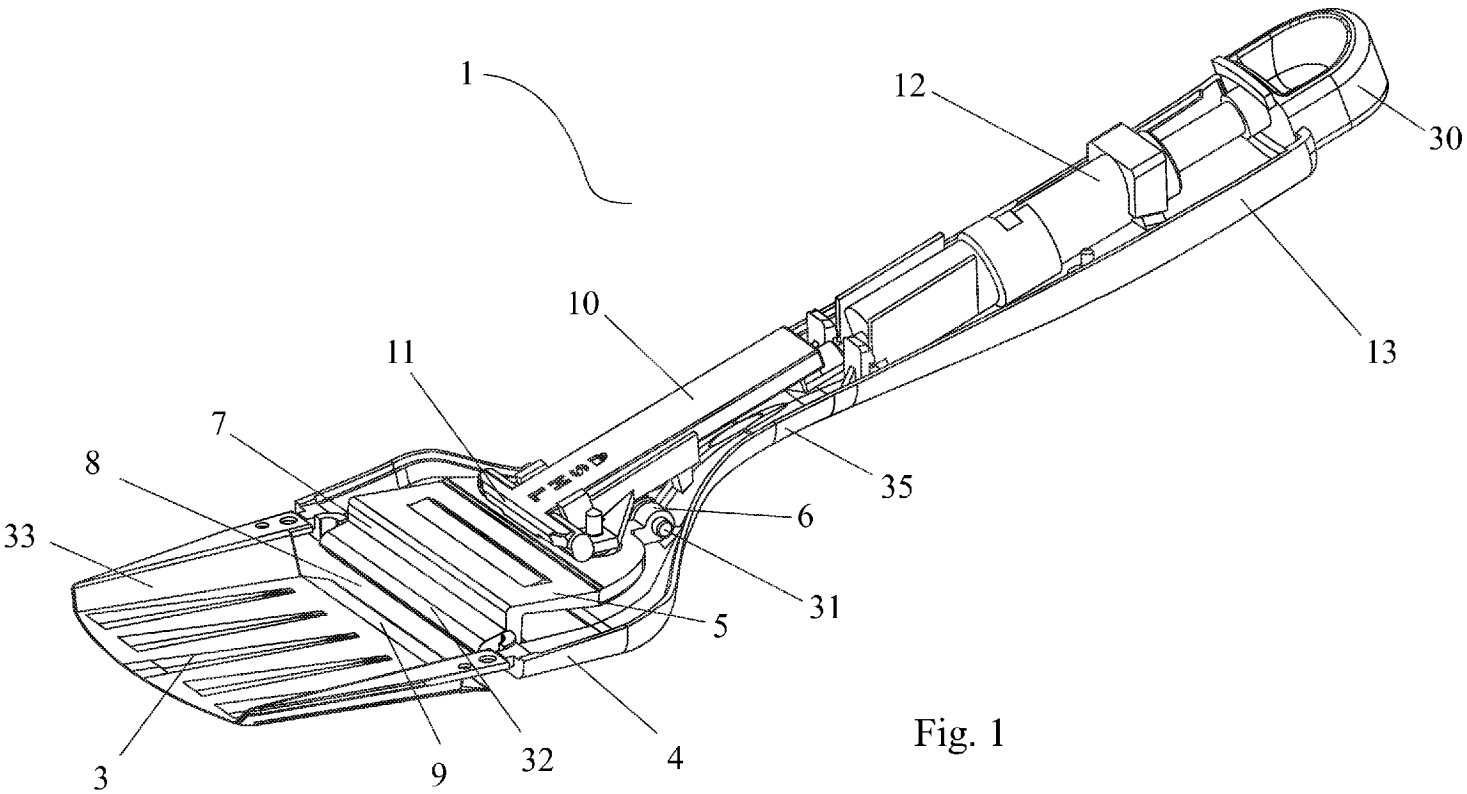
FIG. 1 is a perspective view of a cheese slicer according to an embodiment of the present invention with an upper half of the handle being removed.
Figure 9:
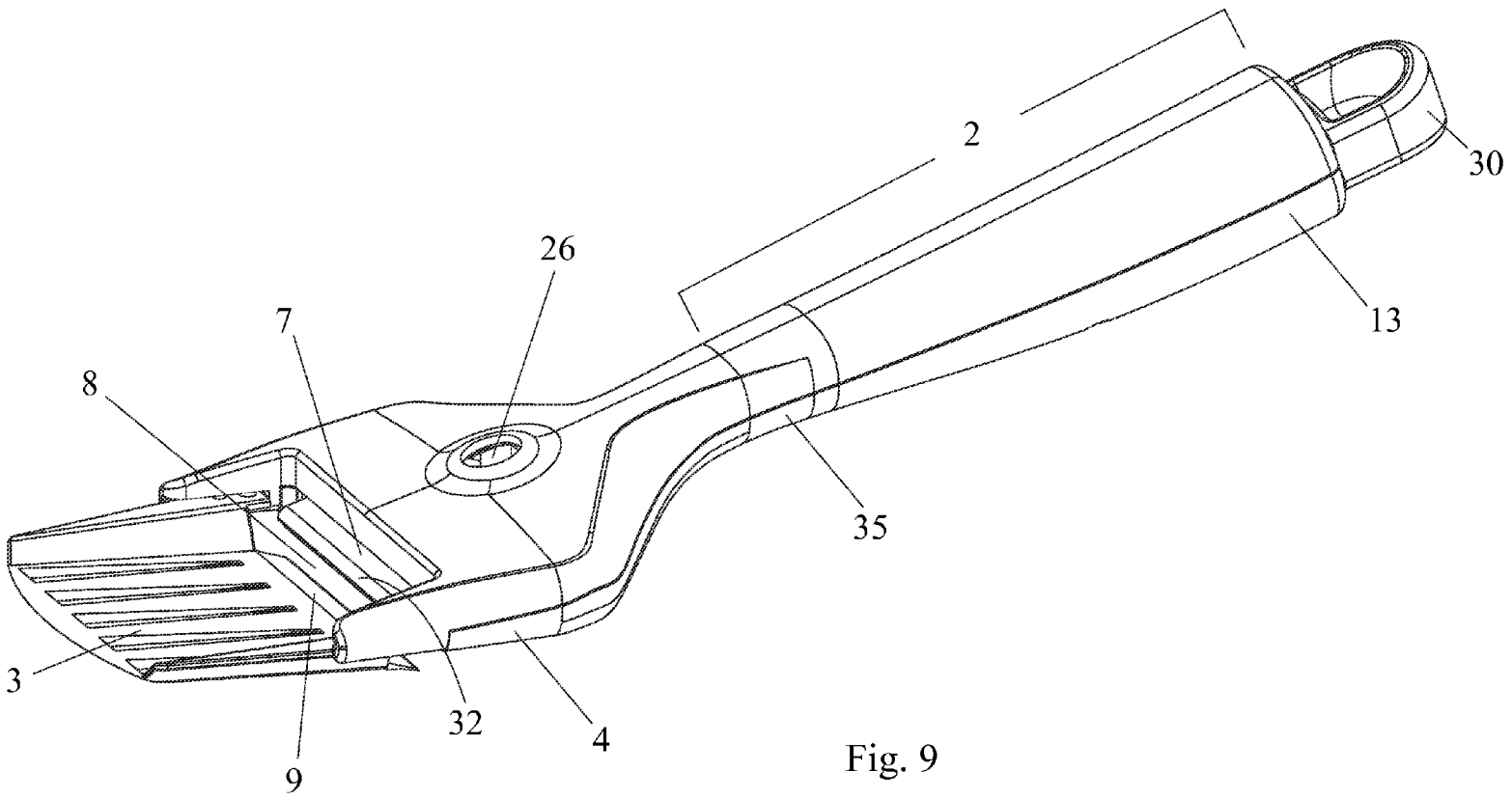
FIG. 9 is perspective view of the cheese slicer shown in FIG. 1 in an assembled state.

Referring now to the drawings, FIG. 1 illustrates in a perspective view a cheese slicer according to a preferred embodiment of the present invention, with the upper half of the handle removed for the sake of clarity. The cheese slicer 1 in a fully assembled state is shown in FIG. 9. The cheese slicer 1 essentially comprises a handle 2, a slicing plate 3, a guiding plate carrier 4, a guiding plate 5, a linkage 10 and an actuator assembly.

The slicing plate 3 is fixed to the guiding plate carrier 4 which is coupled to a first end 35 of the handle 2. The rear edge of the slicing plate 3 is a sharp slicing blade 9 for cutting the cheese. The slicing blade 9 may be provided as a slicing edge formed integrally with the slicing plate 3. Preferably, the slicing plate 3 comprises a pair of side panels 33 formed on opposite sides thereof for guiding the cheese slices.

The guiding plate 5 has a proximal end 6 which is pivotally connected to the first end 35 of the handle 2, and a distal end 7 which is positioned with a variable gap 8 from the slicing blade 9 of the slicing plate 3. In other words, the slicing plate 9 and the distal end 7 of the guiding plate 5 together define the gap as slice thickness for the cheese to be sliced. The guiding plate carrier 4 extends from the first end 35 of the handle 2 towards the slicing plate 3 to provide the support for the guiding plate 5.

Figure 8:
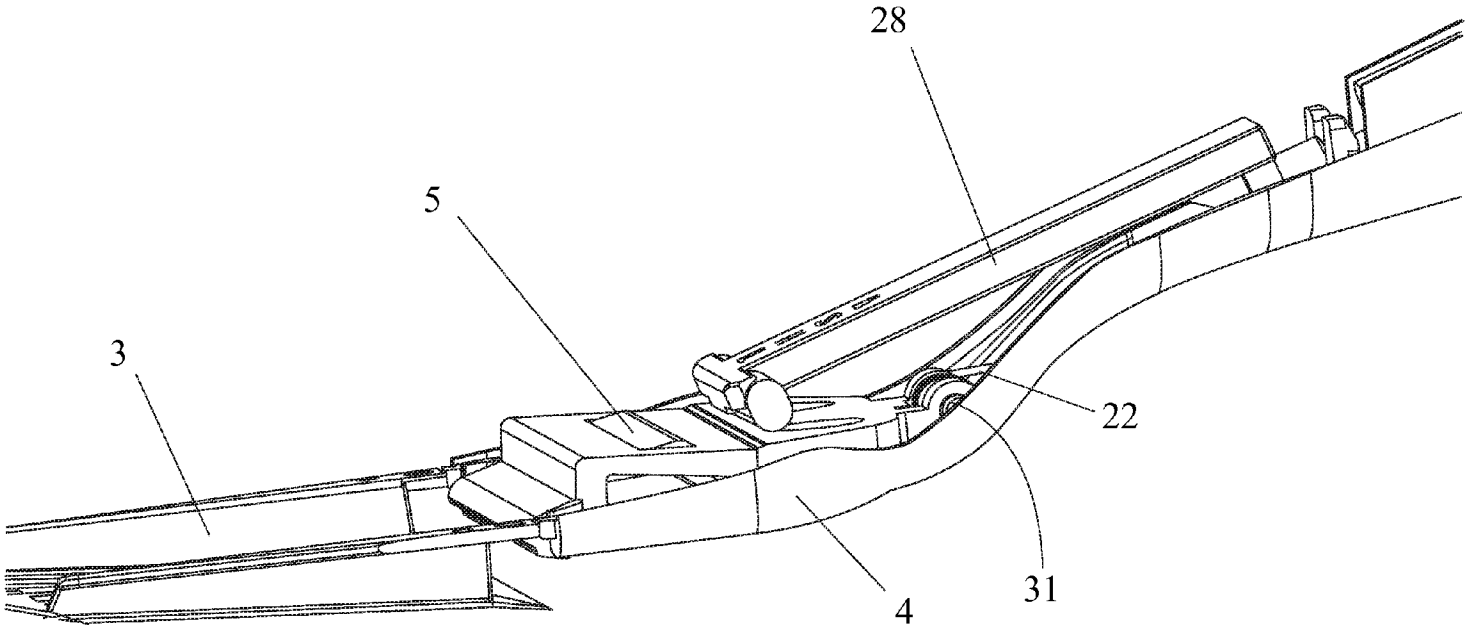
FIG. 8 is a perspective view of the cheese slicer shown in FIG. 1 with the upper half of the handle being removed.

In this embodiment, the proximal end 6 of the guiding plate 5 is pivotally connected to the first end 35 of the handle 2 by a hinge 31, and the gap 8 varies as the guiding plate 5 pivots around the first end 35 of the handle. As illustrated, the distal end 7 of the guiding plate 5 is formed as a step 32 by downwardly extending the guiding plate 5. In this case, the gap 8 is defined by the slicing blade 9 of the slicing plate 3 and the step 32 of the guiding plate 5. As shown in FIG. 9, the step 32 extends out of the handle 2 while the rest of the guiding plate 5 is accommodated within the handle 2. As shown in FIG. 8, a torsion spring 22 runs through the hinge 31 with one leg beneath the guiding plate 5. The torsion spring 22 constantly applies an upward force to a bottom surface of the guiding plate 5, thereby biasing the guiding plate 5 to pivot upward.

Figure 7:
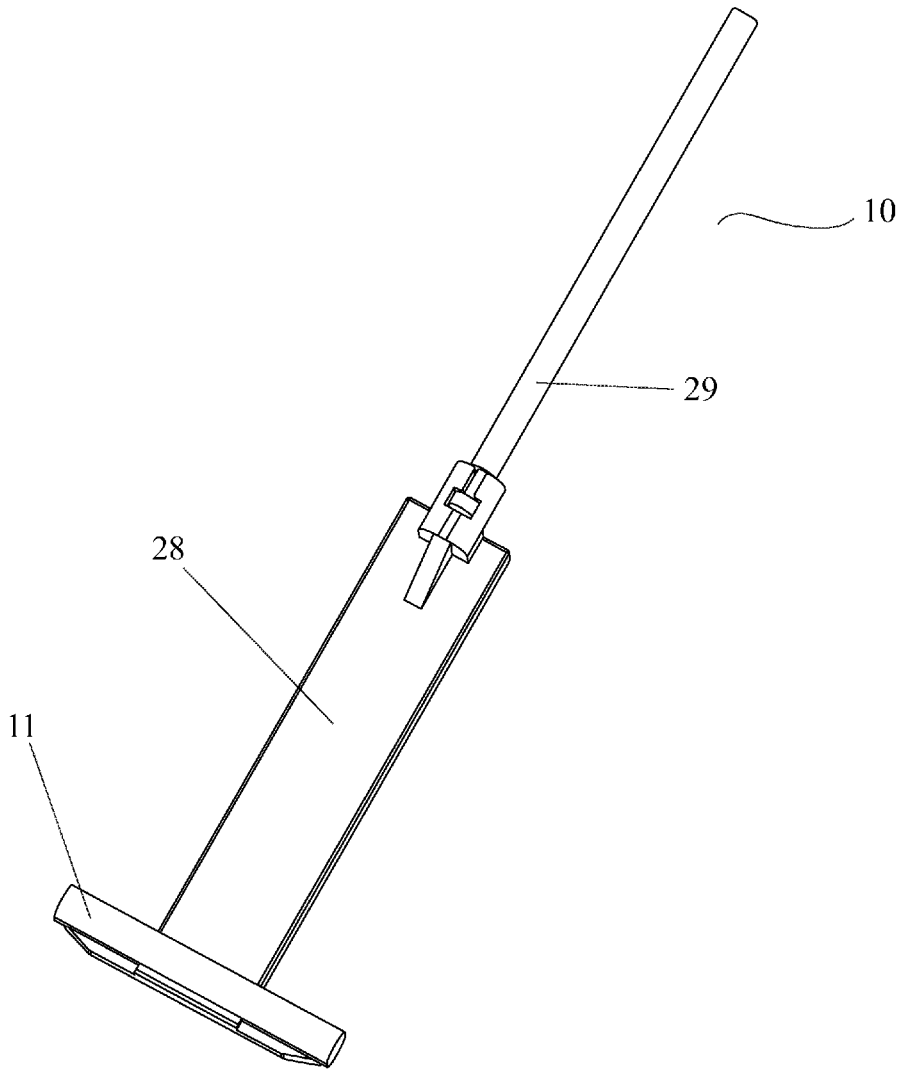
FIG. 7 is a perspective view of the linkage of the cheese slicer shown in FIG. 1.

The linkage 10 is accommodated within the handle 2 and is longitudinally displaceable relative to the handle 2. A lower end of the linkage 10 movably rests against the guiding plate 5. In this embodiment, the lower end of the linkage 10 is terminated by a crossbar 11 which rests against the guiding plate 5. As shown in FIG. 7, in this embodiment, the linkage 10 comprises a first portion 28 and a second portion 29. The second portion 29 comprises one end rotatably coupled to the first portion 28 and the other end fixed to the ratchet 17. Thus, the second portion 29 is rotatable but axially non-displaceable relative to the first portion 28.

As can be seen from the above description and in FIG. 1, when the linkage 10 is activated to move towards the slicing plate 3, the distal end 7 of the guiding plate 5 is forced to pivot towards the slicing blade 9 of the slicing plate 3 with the gap 8 continuously becoming small, such that the slice thickness is becoming thinner; and when the linkage 10 is made to move away from the slicing plate 3, the distal end 7 of the guiding plate 5 is biased by the torsion spring 22 to pivot away from the slicing blade 9 of the slicing plate 3, with the gap 8 continuously becoming larger. In other words, the longitudinal position of the linkage 10 on the guiding plate 5 determines the variable gap 8, i.e. the variable slice thickness.

In this embodiment, the linkage 10 is able to slide to and to be locked in one of four resting positions on the guiding plate 5, creating four predetermined slice thicknesses. Those skilled in the art would understand that the linkage 10 can also be configured to be able to rest on any one of more or less than four resting positions, according to practical needs.

An actuator assembly is provided to move the linkage 10 longitudinally and to lock the linkage 10 in one of the four resting positions. In this embodiment, the actuator assembly is configured as a ballpoint pen ratchet mechanism 12 in operative connection with the linkage 10, such that, every time the ballpoint pen ratchet mechanism 12 is activated, for instance pressed downwardly and then released, the linkage 10 is displaced from one of the four resting positions to another. However, any other mechanism can be used in order to displace and lock the linkage 10.

Figure 2:
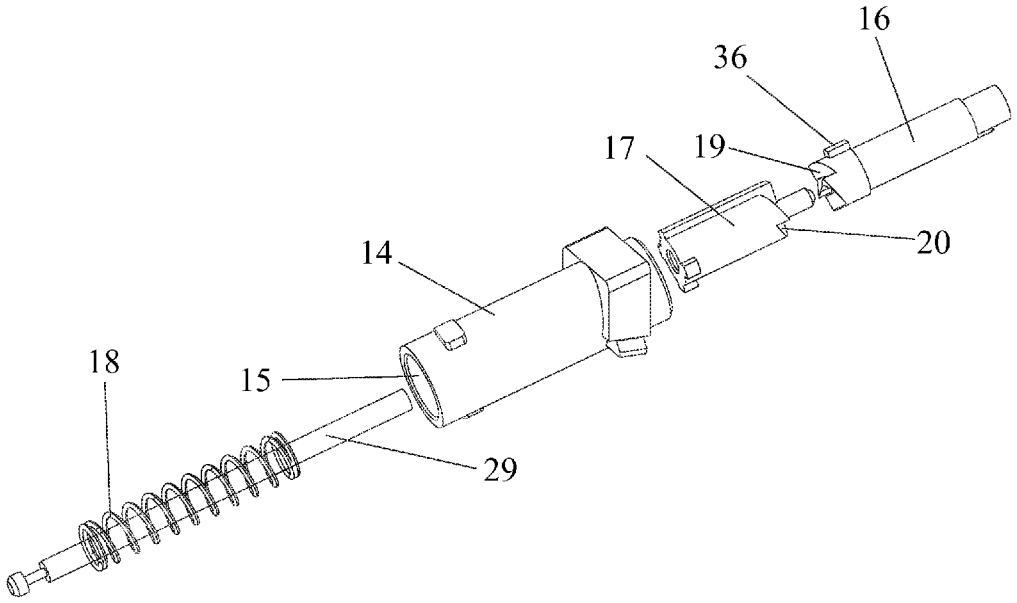
FIG. 2 is a perspective exploded view of the actuator assembly of the cheese slicer shown in FIG. 1.
Figures 3A, 3B, 3C, 3D:
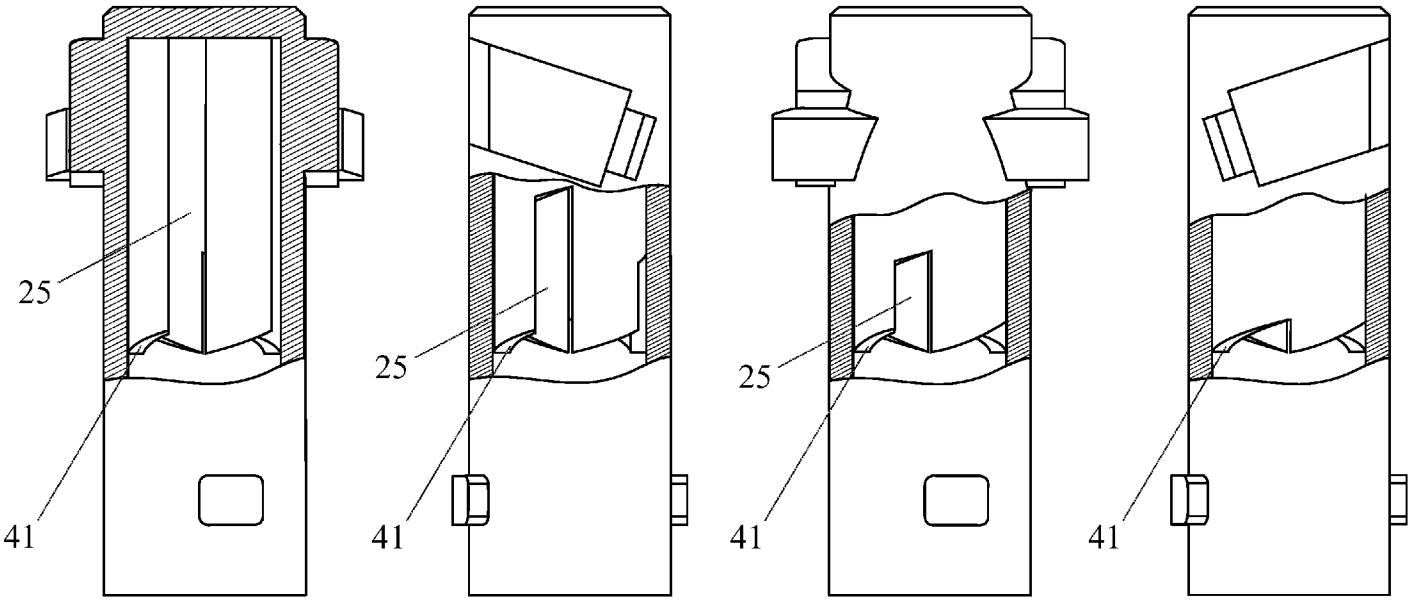
FIG. 3*a* is a side view, partially broken away and partially in hidden view, of the sleeve of the actuator assembly shown in FIG. 2.
FIG. 3*b* is a view similar to that in FIG. 3*a* but with the sleeve being rotated by 90 degrees in the clockwise direction when viewed from above.
FIG. 3*c* is a view similar to that in FIG. 3*a* but with the sleeve being rotated by 180 degrees in the clockwise direction when viewed from above.
FIG. 3*d* is a view similar to that in FIG. 3*a* but with the sleeve being rotated by 270 degrees in the clockwise direction when viewed from above.
Figure 4:
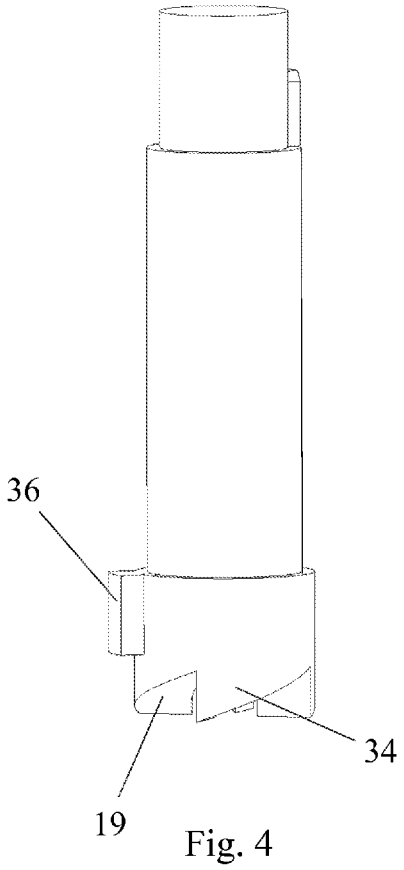
FIG. 4 is a perspective view of the push plunger of the actuator assembly shown in FIG. 2.

Referring to FIGS. 2-5, the ballpoint pen ratchet mechanism 12 will now be explained in details. As shown in FIG. 2, the ballpoint pen ratchet mechanism comprises a sleeve 14, a push plunger 16, a ratchet 17 and a compression spring 18. FIGS. 3*a*-3*d* illustrate in a partially broken away side view the sleeve 14. The sleeve 14 is fixedly accommodated in the handle 2, and has a longitudinal throughbore 15. The push plunger 16 as shown in FIG. 4 is partially received in the throughbore 15. As can be seen in FIG. 4, the push plunger 16 is shaped as a hollow cylinder with four downwardly extending portions 34 arranged evenly on the circumference of the bottom of the hollow cylinder. Each of the downwardly extending portions 34 has a bottom cam face 19. A protrusion 36 is formed on an outer surface of the push plunger 16. The protrusion 36 is received and slidable in a longest one of four slots 25 formed in an inner surface of the sleeve 14 (see FIGS. 3*a*-3*d*). Therefore, the push plunger 16 is non-rotatable but longitudinally displaceable relative to the sleeve 14. The push plunger 16 is fixedly connected to a button 30 which extends beyond the second end 13 of the handle 2 and which is configured to be pressed by a user of the slicer.

Figure 5:
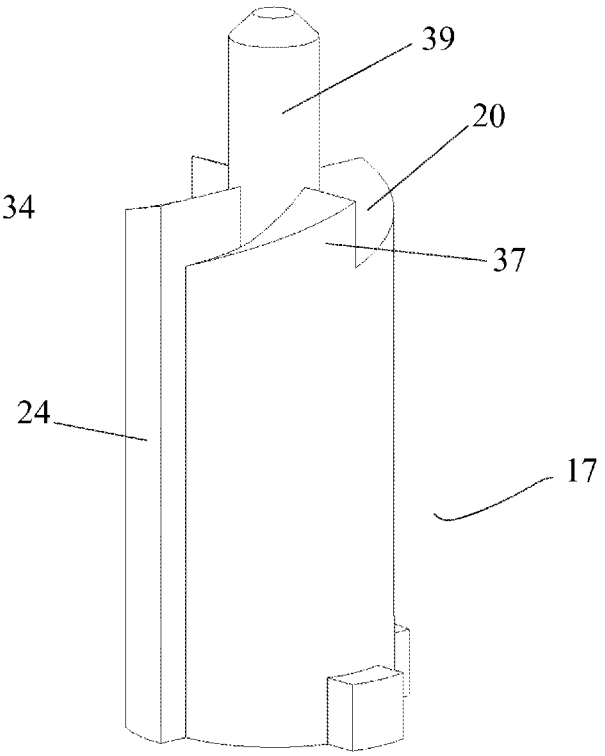
FIG. 5 is a perspective view of the ratchet of the actuator assembly shown in FIG. 2.

As shown in FIG. 5, the ratchet 17 is also shaped as a hollow cylinder with an outer diameter substantially identical to that of the push plunger 16. Four upwardly extending portions 37 are formed evenly on the circumference of the top of the hollow cylinder. Each of the upwardly extending portions 37 has a top cam face 20 which cooperates with each of the four cam faces 19 of the push plunger 16 when the push plunger 16 is pressed against the ratchet 17. A stub 39 extends from the center of the top of the ratchet 17, and is received within the hollow cylinder of the push plunger 16 when the push plunger 16 is pressed against the ratchet 17. An axially extending rib 24 is formed on an outer surface of the ratchet 17. The rib 24 is engagable with any one of the four slots 25 formed in the inner surface of the sleeve 14. Due to the cooperating cam faces 19 and 20, when the push plunger 16 is forced downwardly against the ratchet 17 causing the rib 24 to disengage from the slots 25, the ratchet 17 tends to rotate relative to the sleeve 14 in the anti-clockwise direction when viewed from the top (as the push plunger 16 is non-rotatable relative to the sleeve 14). The linkage 10 is coupled to the ratchet 17 in such a manner that the longitudinal displacement of the ratchet 17 causes the linkage 10 to displace longitudinally on the guiding plate 5. A compression spring 18 is provided to constantly apply an upward force to the ratchet 17 to enable the ratchet 17 move upward after the pressure onto the ratchet is released.

The four slots 25 formed on the inner surface of the sleeve 14 are of different lengths and the rib 24 is rotated to alternately engage with one of the four slots. Therefore, the slots serve as position establishing means which hold the ratchet 17 selectively and alternately in one of four axially spaced locked positions depending on the angle of rotation of the ratchet 17 while the four locked positions of the ratchet 17 are respectively correspondent to the four predetermined resting positions of the linkage 10. For each of the slots 25, each of the opposite sides defining the slot is adjacent to a cam face 41 at the end of the side. The bottom cam faces 41 are configured to cooperate with the cam faces 20 of the ratchet 17 when the ratchet 17 is pushed upwardly by the compression spring 18, causing the ratchet 17 to rotate further relative to the sleeve 14 in the anti-clockwise direction when viewed from the top. The cam faces 41 adjacent to the end of the slots are formed at a same height circumferentially. As the rib 24 of the ratchet 17 engages with one of the slots 25, the length of the slot 25 with which the rib 24 engages determines the longitudinal locked position where the ratchet 17 is locked, which in turn determines the resting position of the linkage 10, and consequently the gap 8.

Thus, to move the linkage 10 from one of the four resting positions to another, the push plunger 16 is first pressed (for example, by a finger of a user) downwardly against the ratchet 17. When the rib 24 of the ratchet 17 is pushed downwardly to disengage from the slots 25, the ratchet 17 rotates in the anti-clockwise direction when viewed from the top. Then the downward pressure applied to the push plunger 16 is released (for example, by removing the finger of the user), and both the push plunger 16 and the ratchet 17 are forced to move upwardly by the compression spring 18. As the ratchet 17 moves upwardly, the cam faces 20 thereof come into contact with the bottom cam faces 41 adjacent to the slot 25, causing the ratchet 17 to rotate further in the anti-clockwise direction when viewed from the top. Depending on the angle of rotation of the ratchet 17, the rib 24 slides into one of the slots 25, and the locked position of the ratchet 17 is determined by the length of said one of the slots 25 into which the rib 24 slides. When the push plunger 16 is pressed downwardly and then released again, the above described process occurs again, moving the ratchet 17 to the next locked position, and consequently moving the linkage 10 to the next resting position. In other words, every time the push plunger 16 is pressed downwardly and then released, the ratchet 17, and consequently the linkage 10, is selectively and alternately held in one of four axially spaced positions, which correspond to four different gaps 8, i.e. four slice thicknesses.

Figure 6:
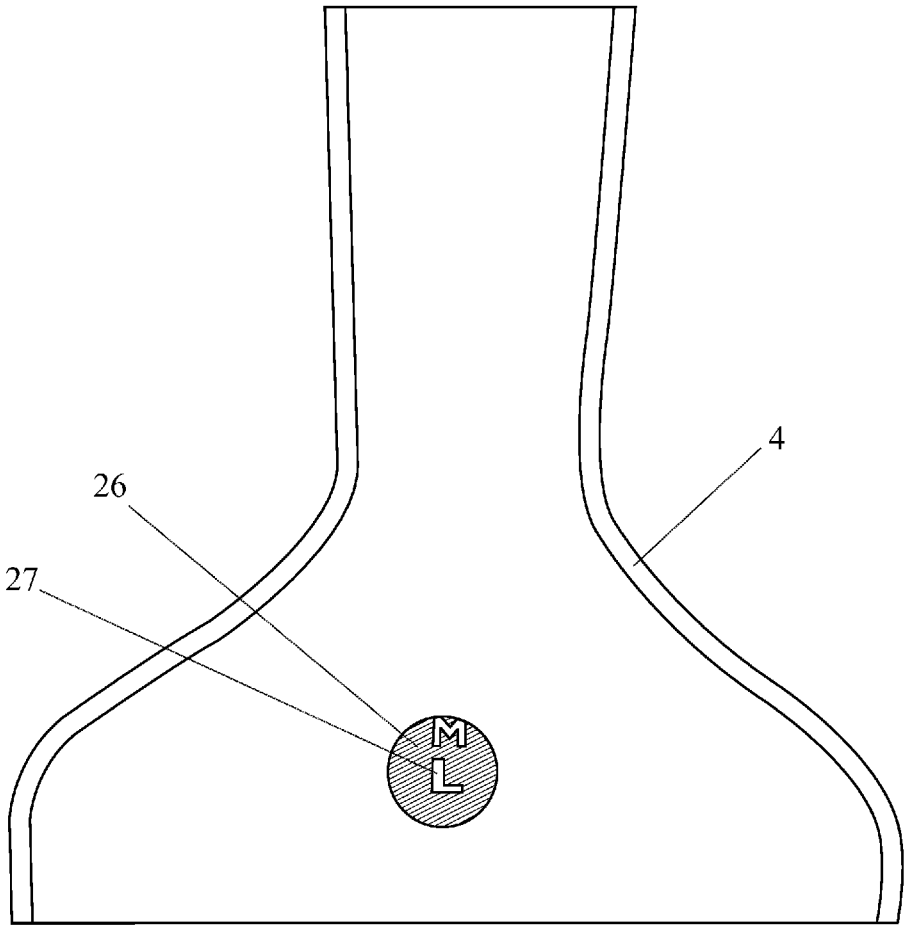
FIG. 6 is a top view of the indicating mechanism of the cheese slicer shown in FIG. 1.

To clearly indicate how much the slice thickness to be selected is, the cheese slicer of the present invention further comprises an indicating mechanism, which is illustrated in FIG. 6. As illustrated, an indicating window 26 is formed on top of the handle 2. Four indicators 27 are arranged in sequence on the linkage 10 to move with the latter. The four indicators 27 can be four indicating symbols like "S", "M", "L" as shown in FIG. 6, which correspond to the slice thickness being 0, 1, 3 and 5 millimeters, respectively. The four indicators 27 are positionally spaced to correspond to the respective four resting positions of the linkage 10, thereby creating a correspondence between the indicators 27 and the predetermined slice thicknesses. In operation, the indicator 27 corresponding to the selected resting position is caused to move a position where the indicating window 26 is located and exposed through the indicating window 26. Such an indicating mechanism allows the user to accurately know the thickness of the cheese slices, prior to slicing the cheese.

While the present invention is described in connection with what is presently considered to be the most practical and preferred embodiment, it should be appreciated that the invention is not limited to the disclosed embodiment, and is intended to cover various modifications and equivalent arrangements included within the spirit and scope of the claims. Modifications and variations in the present invention may be made without departing from the novel aspects of the invention as defined in the claims, and this application is limited only by the scope of the claims.

NUMERICAL REFERENCES

1 cheese slicer
2 handle
3 slicing plate
4 guiding plate carrier
5 guiding plate
6 proximal end of the guiding plate
7 distal end of the guiding plate
8 gap
9 slicing blade
10 linkage
11 crossbar
12 ballpoint pen ratchet mechanism
13 second end of the handle
14 sleeve
15 throughbore
16 push plunger
17 ratchet
18 compression spring
19 cam faces of the push plunger
20 cam faces of the ratchet
22 torsion spring
24 rib
25 slot
26 indicating window
27 indicator
28 first portion of the linkage
29 second portion of the linkage
30 button
31 hinge
32 step of the guiding plate
33 side panel
34 downwardly extending portion of the push plunger
35 first end of the handle
36 protrusion of the push plunger

37 upwardly extending portion of the ratchet
39 stub of the ratchet
41 bottom cam face of the slot

What is claimed is:

1. A cheese slicer (1) comprising: a handle (2) having a first end (35) and a second end (13); a guiding plate (5) having a proximal end (6) pivotally connected to the first end (35) of the handle (2), and a distal end (7); a slicing plate (3) having a slicing blade (9), wherein the slicing blade (9) and the distal end (7) of the guiding plate (5) together define a gap (8) as slice thickness for an item to be sliced; a linkage (10) accommodated in the handle (2) and movably resting against the guiding plate (5) so that the movement of the linkage (10) enables the guiding plate (5) to pivot around the first end (35) of the handle (2) relative to the slicing blade (9) thereby to provide variable slice thickness for the item to be sliced; and an actuator assembly in operative connection with the linkage (10) to move the linkage (10) on the guiding plate (5).

2. The cheese slicer (1) of claim 1, wherein a guiding plate carrier (4) is provided to support the guiding plate (5), and the guiding plate carrier (4) extends from the first end of the handle (2).

3. The cheese slicer (1) of claim 1, wherein the slicing blade (9) is provided as a slicing edge formed integrally with the slicing plate (3).

4. The cheese slicer (1) of claim 1, wherein the linkage (10) is configured to slide to a plurality of resting positions on the guiding plate (5) to create a plurality of predetermined slice thicknesses.

5. The cheese slicer (1) of claim 4, wherein the actuator assembly is configured as a ballpoint pen ratchet mechanism (12) provided in the handle (2), which is latched in a plurality of locked positions, so that the plurality of locked positions are respectively correspondent to the plurality of resting positions of the linkage (10) on the guiding plate (5).

6. The cheese slicer (1) of claim 5, wherein the ballpoint pen ratchet mechanism (12) comprises: a push plunger (16), and a ratchet (17) connected to a compression spring (18) which is forced to move the ratchet (17) upward and coupled to the linkage (10), wherein the push plunger (16) and the ratchet (17) comprise cooperating cam faces (19, 20) whereby the ratchet (17) tends to rotate when the cam faces of the push plunger (16) are forced against the cam faces of the ratchet (17), and the rotation of the ratchet (17) results in an axial displacement of the ratchet (17) among the plurality of locked positions, which causes the linkage (10) to slide to the plurality of resting positions.

7. The cheese slicer (1) of claim 6, wherein the ballpoint pen ratchet mechanism (12) further comprises a sleeve (14) having a plurality of spaced apart axial slots (25) of different lengths formed on an inner wall thereof; and the ratchet (17) comprises an axial rib (24) which is rotated to alternately engage with the respective axial slots (25) of the sleeve (14), thereby allowing the ratchet (17) to reach the respective locked positions.

8. The cheese slicer (1) of claim 6, wherein the ballpoint pen ratchet mechanism (12) comprises a button (30) fixedly connected to the push plunger (16) and extending beyond the second end (13) of the handle (2).

9. The cheese slicer (1) of claim 6, wherein the linkage (10) is configured to have a first portion (28) terminated by a crossbar (11) resting on the guiding plate (5), and a second portion (29) having one end rotatably coupled to the first portion (28) and the other end fixed to the ratchet (17).

10. The cheese slicer (1) of claim 1, wherein a torsion spring (22) is provided beneath the guiding plate (5) to bias the guiding plate to pivot upward.

11. The cheese slicer (1) of claim 1, wherein the handle (2) comprises an indicating window (26); and a plurality of indicators (27) corresponding to the slice thicknesses to be selected are arranged on the linkage (10) and configured in such a manner that the indicator (27) corresponding to the selected slice thickness moves to be exposed through the indicating window (26) with the movement of the linkage (10) to a position on the guiding plate (5) which creates the selected slice thickness.

12. The cheese slicer (1) of claim 1, wherein the guiding plate (5) is pivotally connected to the first end (35) of the handle (2) by a hinge (31).

13. The cheese slicer (1) of claim 1, wherein the distal end (7) of the guiding plate (5) is formed as a step (32) by downwardly extending the guiding plate.

14. The cheese slicer (1) of claim 1, wherein the slicing plate (3) comprises a pair of side panels (33) on opposite sides thereof for guiding the sliced cheese.

* * * * *